US005895775A

United States Patent [19]

Shiau

[11] Patent Number: 5,895,775

[45] Date of Patent: Apr. 20, 1999

[54] MICROWAVE GRATING FOR DISPERSIVE DELAY LINES HAVING NON-RESONANT STUBS SPACED ALONG A TRANSMISSION LINE

[75] Inventor: Ming-Jong Shiau, Cerritos, Calif.

[73] Assignee: TRW Inc., Redondo Beach, Calif.

[21] Appl. No.: 08/634,994

[22] Filed: Apr. 19, 1996

[51] Int. Cl.[6] ..... H01P 1/18; H01B 1/12

[52] U.S. Cl. ..... 505/210; 505/700; 505/701; 505/866; 333/99.005; 333/161

[58] Field of Search ..... 333/161, 156, 333/995; 505/210, 700, 701, 866

[56] References Cited

U.S. PATENT DOCUMENTS

| | | | |
|---|---|---|---|
| 3,719,906 | 3/1973 | Tournois . | |
| 3,849,745 | 11/1974 | Schellenberg et al. . | |
| 4,591,270 | 5/1986 | Ahlén | 356/333 |
| 4,801,836 | 1/1989 | Mariani | 310/313 D |
| 4,962,987 | 10/1990 | Doran . | |
| 4,976,518 | 12/1990 | Burns . | |
| 4,997,249 | 3/1991 | Berry et al. . | |
| 5,101,455 | 3/1992 | Goutzoulis | 385/24 |
| 5,125,051 | 6/1992 | Goutzoulis | 385/27 |
| 5,208,213 | 5/1993 | Ruby | 501/700 X |
| 5,210,807 | 5/1993 | Ames | 385/24 |
| 5,214,729 | 5/1993 | Koai | 385/27 |
| 5,258,626 | 11/1993 | Suzuki et al. | 257/39 |
| 5,270,671 | 12/1993 | Waterman | 333/161 |
| 5,276,746 | 1/1994 | Adar | 385/27 |
| 5,367,586 | 11/1994 | Glance et al. | 385/24 |
| 5,369,519 | 11/1994 | Islam | 359/173 |
| 5,461,687 | 10/1995 | Brock | 385/37 |
| 5,472,935 | 12/1995 | Yandrofski | 505/210 |

FOREIGN PATENT DOCUMENTS

| | | | |
|---|---|---|---|
| 224501 | 9/1988 | Japan | 333/161 |

*Primary Examiner*—Benny T. Lee
*Attorney, Agent, or Firm*—Michael S. Yatsko

[57] ABSTRACT

A microwave grating 10 for a dispersive delay line, the grating comprising: (a) a terminal 12 for receiving a wideband RF signal including multiple RF signals of different frequencies; (b) a primary transmission line 14 capable of carrying the wideband RF signal, the primary transmission line 14 being electrically connected to said terminal 12; and (c) a plurality of non-resonant open-stub transmission lines 16 each having a length 18, the open-stub transmission lines 16 being capacitively loaded on the primary transmission line 14 at spaced locations 20 along the primary transmission line 14. Each open-stub transmission line 16 effects perturbations in the signal carrying capability of the primary transmission line 14 where the open-stub transmission line is located. As such, RF signals of different frequencies propagating through the primary transmission line 14 are reflected back to the terminal 12 of the grating 10 at different points along the primary transmission line 14 where the open-stub transmission lines 16 are located. Preferably, the spacing 22 between a pair of adjacent open-stub transmission lines 16 is substantially equal to a multiple half-wavelength of a selected frequency, whereby an RF signal of said frequency propagating through the primary transmission line 14 is reflected back at a point along the transmission line 14 where the spacing 22 between a pair of open-stub transmission lines 16 is equal to a multiple half-wavelength of the signal.

13 Claims, 8 Drawing Sheets

MICROWAVE GRATING FOR DISPERSIVE DELAY LINES HAVING NON-RESONANT STUBS SPACED ALONG A TRANSMISSION LINE

BACKGROUND OF THE INVENTION

The present invention generally relates to microwave dispersive lines and in particular to wideband, low loss dispersive lines.

Wideband, low loss dispersive lines operated at microwave or higher frequencies are increasingly utilized in analog signal processing systems. Such systems include post detection receivers of high performance radars, spread-spectrum communications and spectral analyzers. A dispersive line provides delay at microwave frequencies. An input signal including signals of different frequencies is launched as a forward-propagating wave on the line. At specified points along the line a portion of the signal energy is reflected in a backward-propagating wave along the line. Signals of different frequencies are reflected back along different points on the line, thereby providing different delay periods for different frequencies.

Existing dispersive delay lines typically utilize either surface-acoustic-wave (SAW) technology, or high temperature superconductive (HTS) backward coupler technology. Both technologies, however, have several important disadvantages when used in high frequency wideband signal processing applications. The SAW technology can only be utilized for signal frequencies of up to 1 GHz which is substantially below microwave frequencies of 2 GHz or higher. The physical dimensions of SAW circuits are impractical for frequencies of 2 GHz or higher. Further, the tolerances of SAW circuits are inadequate for the demands of high performance signal processing systems.

Although HTS backward coupler circuits can operate at microwave or higher frequencies, for a wideband, long dispersive delay line, multiple directional couplers and interconnecting uncoupled transmission lines are required. Each coupler must be developed before it is cascaded in a coupler circuit unit, requiring substantial development costs. Further, to fit the circuits into HTS wafers, the multiple coupled and uncoupled transmission lines must be bent at the same time into two meander lines. As such, the circuits are of substantial size and do not make efficient usage of the HTS wafers since only a small portion of the surfaces of the wafers are utilized.

There is, therefore, a need for a wideband, low loss, long dispersive delay line which can operate at microwave frequencies or higher without requiring large circuit dimensions. There is also a need for such a delay line to be cost effective to fabricate and make efficient use of wafer space.

SUMMARY OF THE INVENTION

The present invention satisfies these needs. The present invention provides a microwave grating for a dispersive delay line, the grating comprising: (a) a terminal for receiving a wideband RF signal including multiple RF signals of different frequencies; (b) a primary transmission line capable of carrying the wideband RF signal, the primary transmission line being electrically connected to said terminal; and (c) a plurality of non-resonant open-stub transmission lines each having a length, the open-stub transmission lines being capacitively loaded on the primary transmission line at spaced locations along the primary transmission line.

Each open-stub transmission line effects perturbations in the signal carrying capability of the primary transmission line where the open-stub transmission line is located. As such, RF signals of different frequencies propagating through the primary transmission line are reflected back to the terminal of the grating at different points along the primary transmission line where the open-stub transmission lines are located. Preferably, the primary transmission line and the open-stub transmission lines are high temperature superconductive striplines deposited on a substrate.

For every pair of adjacent open-stub transmission lines, the spacing between the pair is different from that of other pairs of adjacent open-stub transmission lines. The spacing between a pair of adjacent open-stub transmission lines is substantially equal to a multiple half-wavelength of a selected frequency, whereby an RF signal of said frequency propagating through the primary transmission line is reflected back at a point along the transmission line where the spacing between a pair of open-stub transmission lines is equal to a multiple half-wavelength of the signal.

Preferably, the spacing between adjacent open-stub transmission lines increases linearly as the distance between the open-stub transmission lines and the terminal of the grating increases. More preferably, the length of the open-stub transmission lines increases linearly as the distance between the open-stub transmission lines and the terminal of the grating increases.

BRIEF DESCRIPTION OF THE DRAWINGS

These and other features, aspects and advantages of the present invention will become understood with reference to the following description, appended claims and accompanying drawings where:

DETAIL DESCRIPTION OF THE INVENTION

Figure 1:
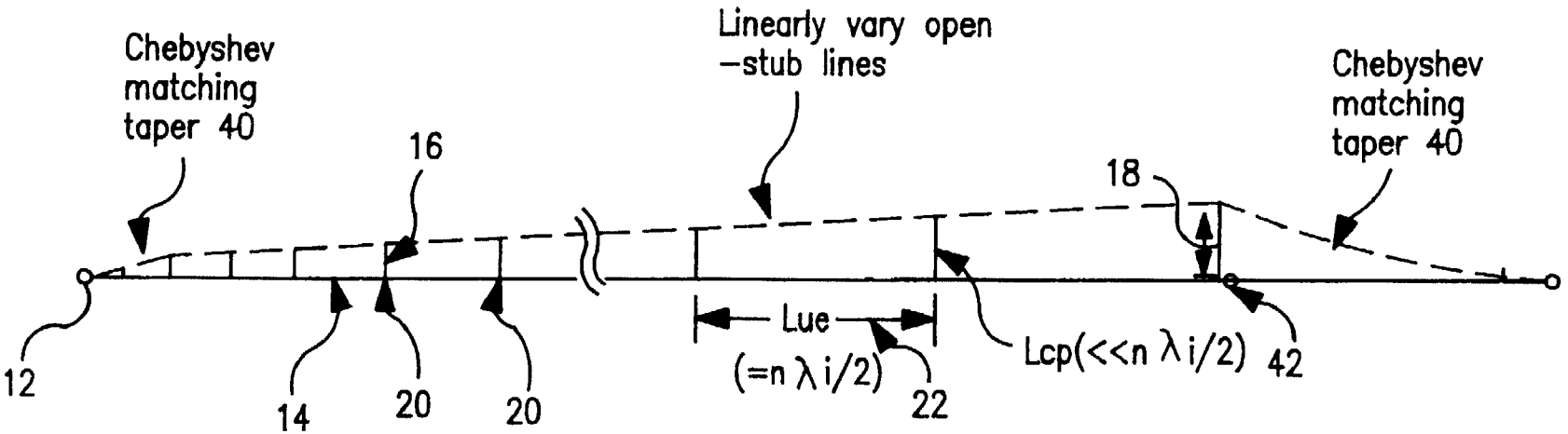
FIG. 1 is a schematic of an embodiment of a dispersive microwave grating according to the present invention.

Referring to FIG. 1, a schematic of an embodiment of a microwave grating 10 for a dispersive delay line according to the present invention is shown. The grating comprises: (a) a terminal 12 for receiving a wideband RF signal including multiple RF signals of different frequencies; (b) a primary transmission line 14 capable of carrying the wideband RF signal, the primary transmission line 14 being electrically connected to said terminal 12; and (c) a plurality of non-resonant open-stub transmission lines 16 each having a length 18, the open-stub transmission lines 16 being capacitively loaded on the primary transmission line 14 at spaced locations 20 along the primary transmission line 14.

Each open-stub transmission line 16 effects perturbations in the signal carrying capability of the primary transmission line 14 where the open-stub transmission line 16 is located, such that RF signals of different frequencies propagating through the primary transmission line 14 are reflected back to the terminal 12 of the grating 10 at different points along the primary transmission line 14 where the open-stub transmission lines 16 are located.

The open-stub transmission lines 16 are electrically connected to the primary transmission line 14 and each open-stub transmission line 16 functions as a capacitive load on the primary transmission line 14. For every pair of adjacent open-stub transmission lines 16, the spacing 22 between the pair is different from that of other pairs of adjacent open-stub transmission lines 16. Preferably, the spacing 22 between a pair of adjacent open-stub transmission lines 16 is substantially equal to a multiple half-wavelength of a selected frequency represented by the formula:

$$L_{ue}i=\lambda_i/2$$

where $\lambda_i$ is the wavelength of the frequency $F_i$, such that an RF signal of the selected frequency propagating through the primary transmission line 14 is reflected back at a point along the transmission line 14 where the spacing 22 between a pair of open-stub transmission lines 16 is equal to a multiple half-wavelength of the signal. The increase in distance between adjacent open-stub transmission line 16 is expressed as $$L_{ue(+1)}=n\ \lambda_{(i+1)}/2 \text{ and } \lambda_{(i+1)}>\lambda_i.$$

In the preferred embodiment of the invention, the spacing 22 shown in FIG. 1 between adjacent open-stub transmission lines 16 and the length 18 of the open-stub transmission lines are identified as $L_{ue}$ and Lcp respectively. The spacing 22 between the open-stub transmission line corresponds to a value of the frequency $F_i$ over the range of 2 to 4 Ghz. The value for $L_{ue}$ is represented by the equation:

$$L_{ue} \text{ equals } n\ \lambda/2$$

where $\lambda_i$ is the wavelength of the $F_i$ for each value of $F_i$ that is input at the terminals 12 or 42, the length of the i-th ue element is determined by the equation $$L_{ue}=n\ \lambda/2.$$

The length of the open-stub element 18 is identified as $L_{cp}$. The value of $L_{cp}$, is a function of the $L_{ue}$ but is of a much lower value than the preceding spacing $L_{ue}$.

In a preferred embodiment of the invention, the spacing 22 between adjacent open-stub transmission lines 16 and the length 18 of the open-stub transmission lines 16 increase as the distance between the open-stub transmission lines 16 and the terminal 12 of the grating 10 increases. The grating 10 can be used for linear and non-linear dispersive lines depending on the spacing 22 and length 18 of adjacent open-stub transmission lines 16. For a linear dispersive line, the spacing 22 between adjacent open-stub transmission lines 16 and the length 18 of the open-stub transmission lines 16 increase linearly. For non-linear dispersive lines, the spacing 22 and length 18 of the open-stub transmission lines 16 can, for example, increase geometrically.

Alternatively, the spacing 22 between adjacent open-stub transmission lines 16 and the length 18 of the open stub-transmission lines 16 can decrease as the distance between the open-stub transmission lines 16 and the terminal 12 of the grating 10 increases. For a linear dispersive line, the spacing 22 between adjacent open-stub transmission lines 16 and the length 18 of the open-stub transmission lines 16 decrease linearly. In that case, higher frequencies are reflected back further away from the grating terminal 12 and so experience longer delays.

Figure 2:
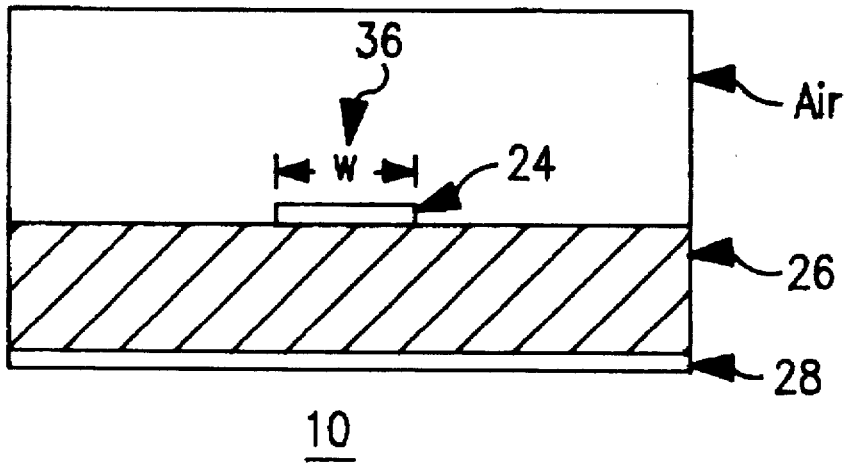
FIG. 2 is a frontal view of a microstrip implementation of the grating of FIG. 1.

The grating 10 can be fabricated by depositing a HTS film 24 shown in equations 2 and 3, patterned as shown in FIG. 1, over a substrate 26 in a one step masking process. Preferably, the grating 10 is patterned in a spiral form or other loosely coupled zig-zag meander lines to fit in a 3 inch diameter wafer. Referring to FIG. 2, a microstrip implementation of the grating 10 of FIG. 1 is shown. The patterned substrate 26 has a conducting ground plane 28 on the bottom of the substrate 26 using a HTS film or a normal conductor having a thickness of about 3 microns. In microstrip implementation of the grating, the substrate 26 patterned with the HTS film 24 can be exposed to air. The line width "W" of the impedance line 36 in FIG. 2 is about 1.2 mils.

The length 18 of the open-stub transmission lines 16 adjacent to other open-stub transmission lines 16 is represented by the designation $L_{cp}$ which is of a value that is less than the value of n $\lambda/2$.

Figure 3:
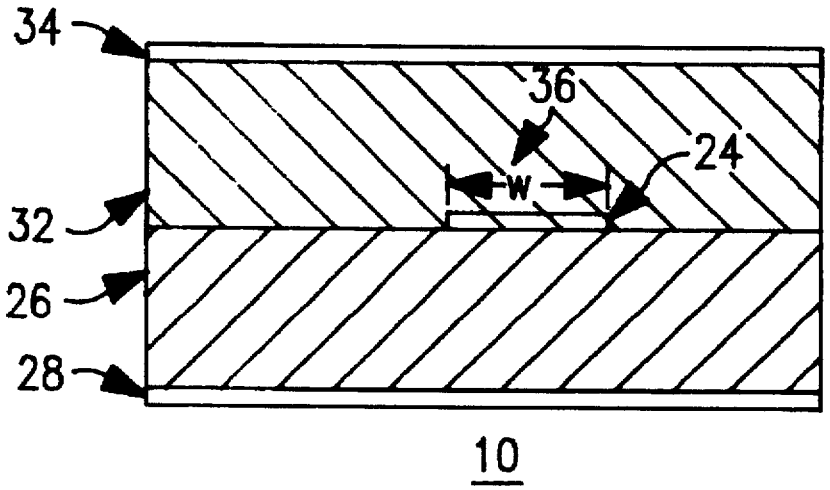
FIG. 3 is a frontal view of a stripline implementation of the grating of FIG. 1.

FIG. 3 shows a stripline implementation of the grating 10 of FIG. 1. In a stripline implementation, the substrate 26 is patterned with an HTS film 24 and is then overlayed with an unpatterned substrate 32. The unpatterned substrate 32 has the same dielectric constant and thickness as the patterned substrate 26. The unpatterned substrate 32 also has a ground plane 34 of a normal conductor or an HTS layer. The preferred substrate for a HTS film to deposit on is $LaALO_3$ which has a dielectric constant of 24. The thickness of a $LaAlO_3$ substrate is typically 40 mils for a stripline implementation operating at 2 to 4 GHz. For a 50 ohm impedance line in a microwave grating, the corresponding linewidth 36 is about 1.7 mils. The element 38 indicates that the loads on the network are matched.

Figure 4:
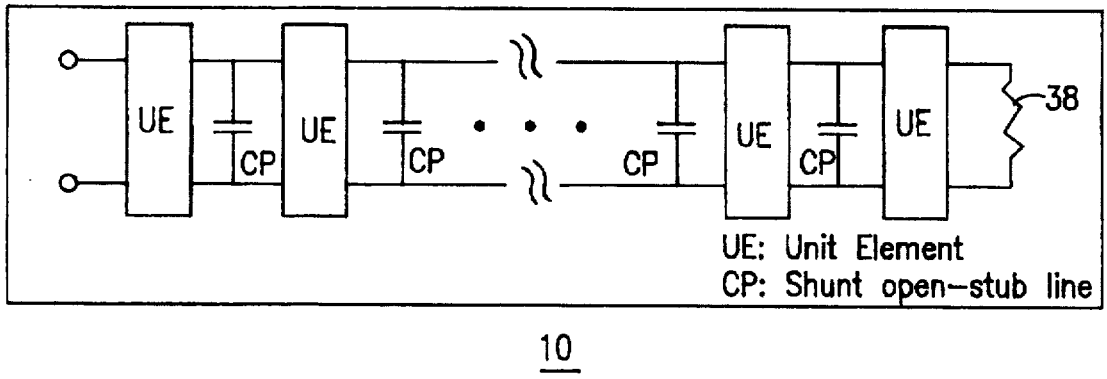
FIG. 4 is a block diagram of an equivalent network of the microwave grating of FIGS. 1, 2 and 3.

Referring to FIG. 4, a block diagram of an equivalent network for the microwave grating 10 of the present invention is shown. The network comprises an alternating cascade of a plurality of unit elements (UE) forming the primary transmission line and open-stub transmission line elements (CP). Each UE or CP element is characterized by a line impedance of Zue or Zcp, respectively. The length of a CP elements (Lcp) is much shorter than the length of UE elements (Lue). Each CP element is a capacitive load, and thus introduces discontinuity or perturbation to the primary transmission line. The element 38 indicates that loads on the network are matched loads. As such, the grating 10 is formed by periodic perturbations.

The variable periodicity or spacing between adjacent CP elements is determined by the length of the UE elements as shown in FIG. 1. Each UE element i has a different length (Lue.i). If the Lue.i of a UE element i is substantially equal to a multiple half-wavelength ($L_{ue}$.i=n (λi)/2 shown in FIG. 1) for a frequency Fi, the constructive reflections between two successive perturbations at the i-th UE element occur for the frequency Fi. Therefore, a signal with the Fi frequency is reflected back at the i-th LE element.

FIG. 1 illustrates a two-terminal grating, sometimes referred to as a two-port grating. The transmission line is connected to terminals 12 and 42. The input of signals with varying frequency signals $F_i$ to terminal 12 will undergo different periods of delay before being reflected back. For example, high frequency signals entering terminal 12, will undergo less delay time than lower frequency signals because the spacing between the open stub lines 16 is increasing when entering from terminal 12 and exiting at terminal 42. When entering at terminal 42, low frequency signals, $F_i$, will experience less delay time than higher frequency signals.

Terminal 12 as shown in FIG. 1 is connected to the transmission line 14 at the point from which the spacing between the open-stub transmission line 16, as n $\lambda/2$ is increasing. Higher frequency RF signals, $F_i$ will experience delays that are shorter in time for the reason that the spacing is increasing. Lower frequency RF signals $F_i$ will experience a delay period that is greater in time before they are reflected back from the grating because the spacing is increasing.

Figure 5:
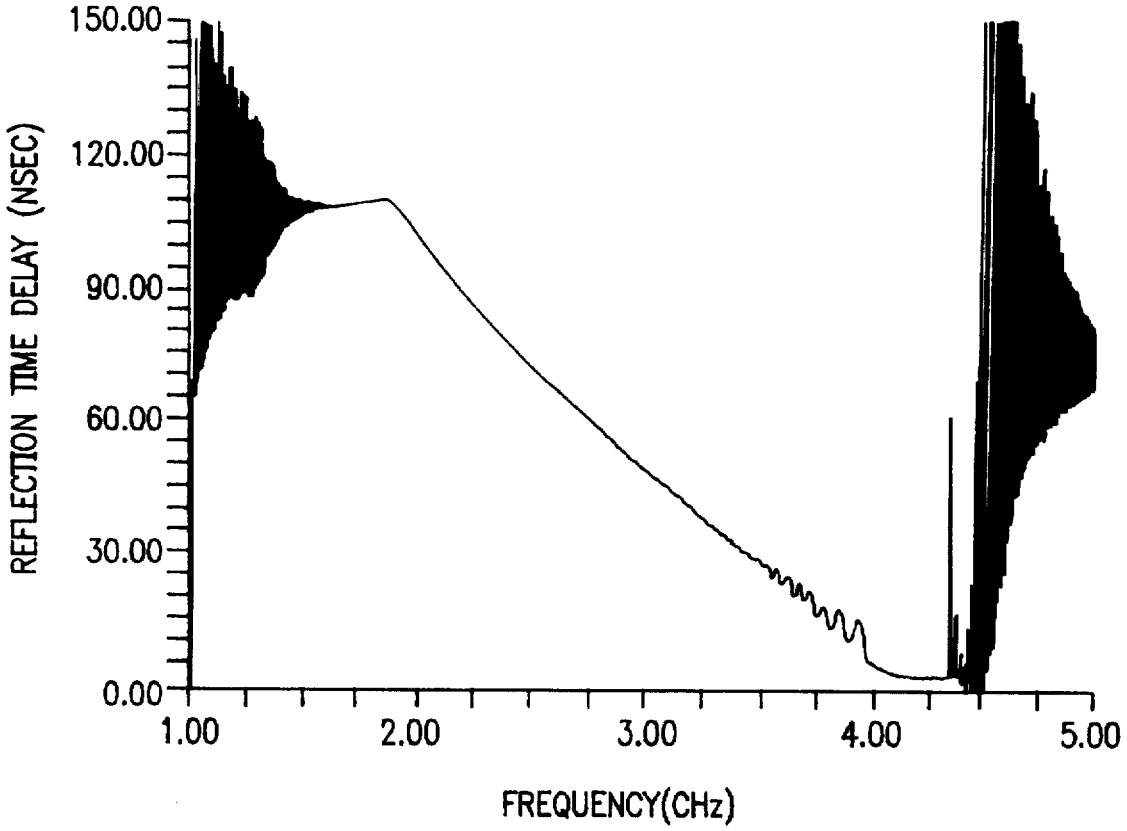
FIG. 5 is a graph of time delay response of a 2 to 4 GHz, 100 nsec dispersive delay line utilizing the microwave grating of FIG. 1.
Figure 6:
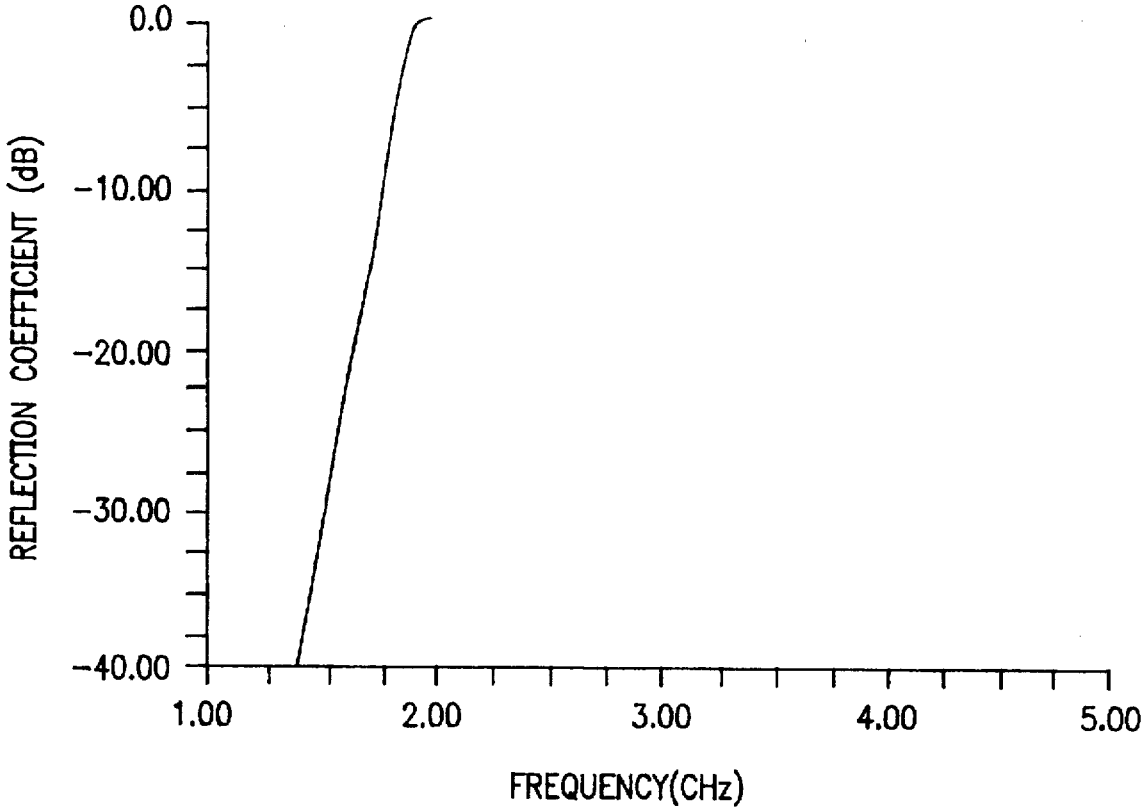
FIG. 6 is a graph of the amplitude response of the dispersive delay line of FIG. 5.

FIG. 5 illustrates a graph of the time delay response exemplary of 2 to 4 GHz, 100 nsec linear dispersive delay line as function of frequency. The delay line utilizes an embodiment of the microwave grating 10 of the present invention. The difference in delay time is 100 nsec between 2 and 4 GHz. FIG. 6 illustrates a graph of the amplitude response, transmission loss (S21 in db), of the delay line of FIG. 5 as a function of every frequency from 2 to 4 GHz.

The grating 10 comprises 301 UE elements and 302 CP elements, where all the UE and the CP elements have the same impedance with Zue=Zcp=1.0 (normalized to a 50 ohm load). The length of the UE elements is linearly tapered from about 1.33 inches to about 2.95 inches (in free space), and the length of the CP elements is linearly tapered from about 0.147 inches to about 0.295 inches (in free space). At the operating frequency of 2 to 4 GHz, the CP elements become capacitive loads on the LE elements. Longer CP elements become inductive loads. To reduce the time delay from 100 nsec to about 50 nsec, the number of UE and CP elements can be halved.

Inside the microwave grating 10, any frequency in the range of 2 to 4 GHz, is reflected at different UE elements. For example, a frequency of about 3 GHz is reflected back from the middle of the grating 10. Frequencies of 2 GHz or lower are not reflected back and simply propagate through the transmission line 14 and are terminated at a load 38, such as a 50 ohm load, as shown in FIG. 4. Frequencies of 4 GHz or higher do not propagate through the grating 10 and are reflected back.

Preferably, two Chebyshev tapers 40, one at the terminal 12 of the grating 10 and the other at an end 42 of the grating 10 as shown in FIG. 1, are utilized to enhance the linear response of the grating 10. The taper at the end 42 of the grating 10 includes 3 to 10 CP elements having a length decreasing from 0.295 inches (in free space), spaced equally at about 2.95 inches (in free space) for a 2 to 4 GHz grating. The taper at the terminal 12 of the grating 10 includes about 3 CP elements having a length decreasing from 0.147 inches (in free space), spaced equally at about 1.33 inches (in free space). The grating 10 can be fabricated from an HTS film deposited on a 20 mil thick $LaAlO_3$ (Er=24) stripline to prevent high insertion loss and to miniaturize the grating in a small package.

Advantageously, the grating 10 of the present invention can be simply bent in a highly dense meander line without crosstalk between adjacent lines. This is because the length 18 of the open-stub elements 16 is substantially shorter than the spacing 22 between adjacent open-stub elements 16. As a result, the grating 10 of the present invention can be utilized in a compact, low cost HTS dispersive delay line with superior performance compared to the costly existing technologies described above.

Figure 7:
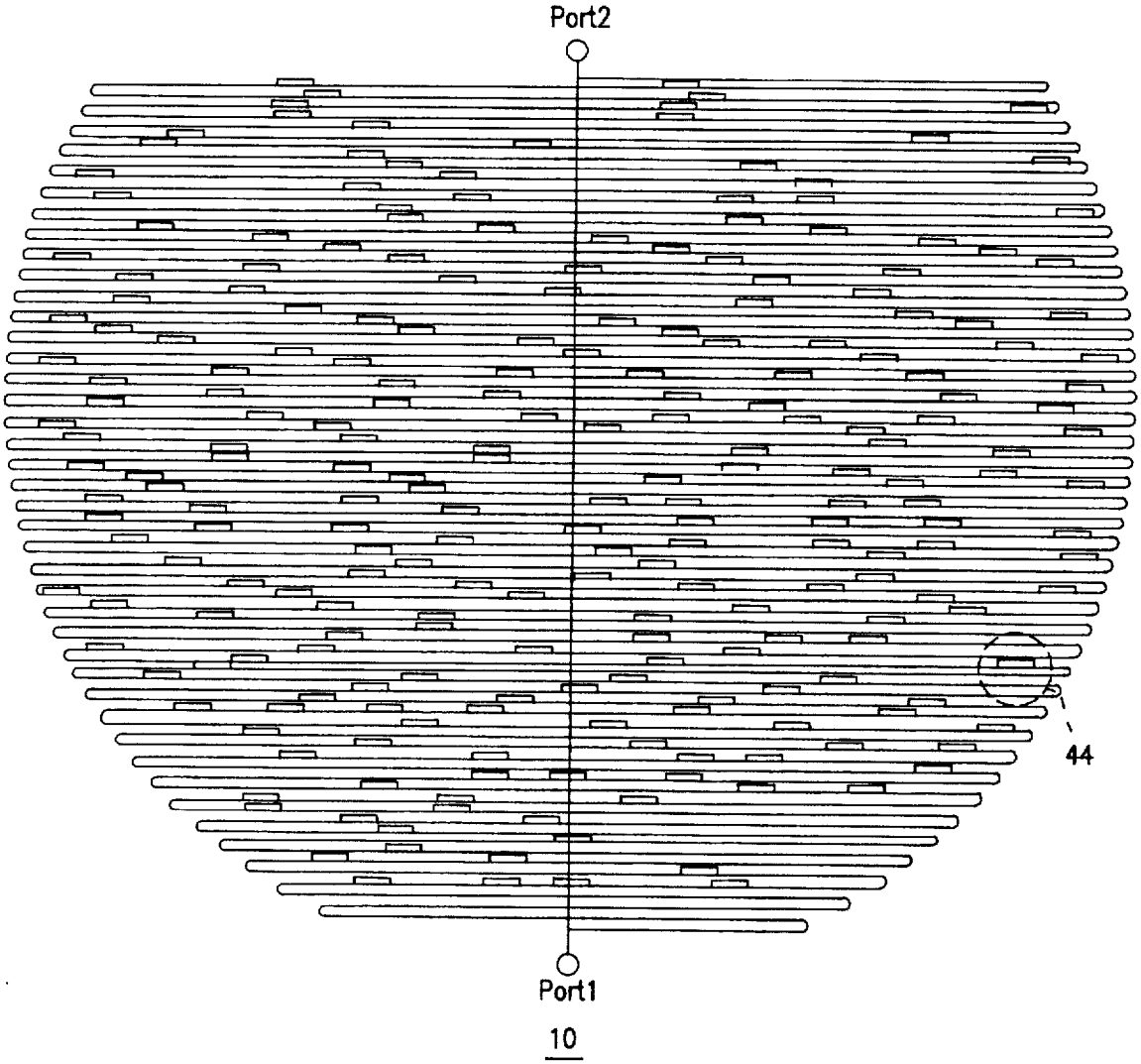
FIG. 7 is a schematic of an example zig-zag layout of the grating of FIG. 1.
Figure 8:
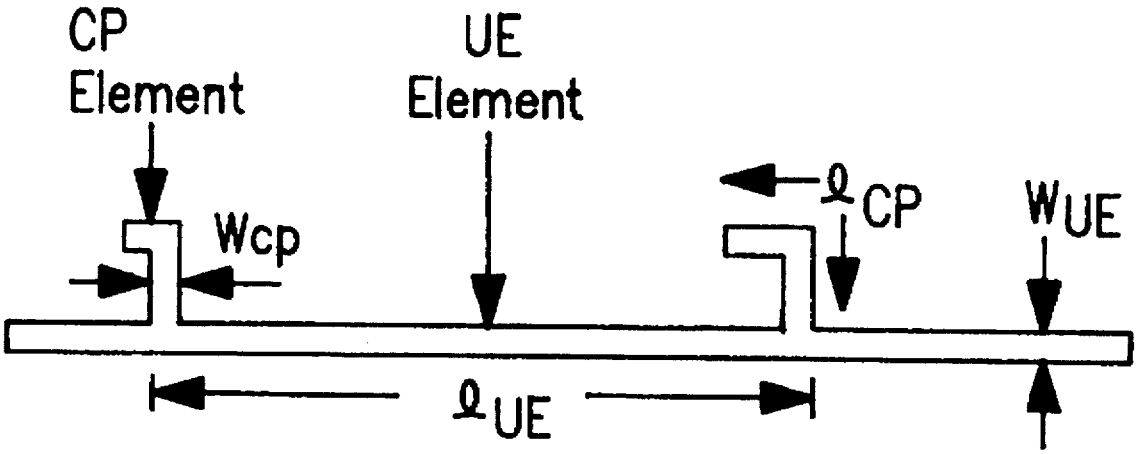
FIG. 8 is a detailed schematic of a portion of the layout of FIG. 7.

Referring to FIG. 7, an example zig-zag layout for the grating 10 of FIG. 1 is shown. The layout includes a 40 mil thick $LaAlO_3$ substrate on a 2 inch diameter wafer, providing 100 nsec linearly dispersive delay for operation from 2 to 4 GHz. The grating 10 has an input port (port 1) to receive input signal, and an output port (port 2) for passing unreflected signals through the grating 10 to a load 38 such as shown in FIG. 4. Referring to FIG. 8, a detailed schematic of a portion 44 of the layout of FIG. 7 is shown. The impedance (Zue) of each UE element is about 50 ohms. The impedance (Zcp) of each CP element is about 50 ohms. The width (Wue) of each UE element is about 8.39 mil in free space or about 1.7 mil in LaAlO3 stripline. The width (Wcp) of each CP element is substantially equal to the width of the UE elements. The length (Lue) of the UE elements ranges from about 1.33 inches to about 2.95 inches linearly in free space, or from about 0.27 inches to about 0.60 inches linearly in LaAlO3 stripline. The length (Lcp) of the CP elements ranges from about 0.147 inches to about 0.295 inches linearly in free space, or from about 0.03 inches to about 0.06 inches linearly in LaAlO3 stripline.

Figure 9:
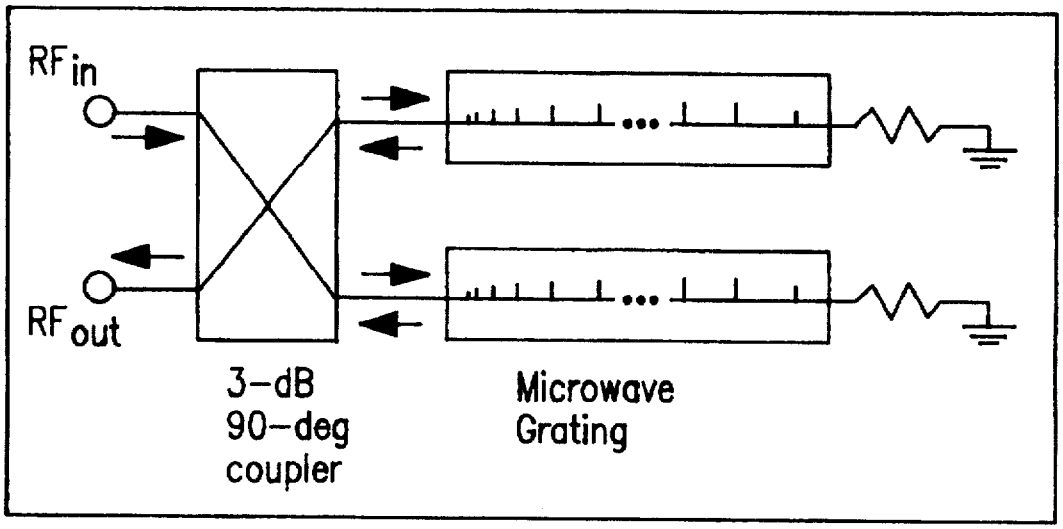
FIG. 9 is a schematic of a dispersive delay line utilizing two microwave gratings of FIG. 1.

Referring to FIG. 9 a schematic exemplary dispersive delay line utilizing two microwave gratings according to the present invention is shown. The delay line comprises: (a) a set of input terminals for receiving a wideband RF signal including multiple RF signals of different frequencies; (b) a splitting coupler for equally splitting the wideband RF signal into two 90 degree out of phase signals, the coupler including a pair of output terminals, each output terminal carrying one of the out of phase signals, wherein the coupler is electrically connected to the input terminals; (c) a pair of microwave gratings for providing dispersive signal reflection, each grating having a terminal electrically connected to an output terminal of the coupler, wherein the out of phase signals propagate through the gratings and signals of different frequencies are reflected back to the terminals of the gratings at different points along the gratings; and (d) a combining coupler electrically coupled to the terminals of the gratings for receiving the reflected signals and combining the two reflected signals into a single output signal.

In this embodiment, a 3-dB 90 degree directional coupler is utilized to perform the function of the splitting coupler and the combining coupler. Signals through the RFin terminal of the delay line are equally split in amplitude but 90 degrees out of phase. Frequencies between 2–4 GHz are reflected back from the two gratings and recombined by the coupler and sent out through RFout. Alternatively, a circulator (connected with a single grating) can be utilized instead of the coupler for narrow bandwidths such as of 2–2.5 GHz or 3–3.5 GHz.

The present invention has been described in considerable detail with reference to certain preferred versions thereof; however, other versions are possible. Therefore, the spirit and scope of the appended claims should not be limited to the description of the preferred versions contained herein.

What is claimed is:

1. A microwave grating for a dispersive delay line, the grating comprising:

(a) a terminal for receiving a wideband RF signal including multiple RF signals of different frequencies;

(b) a primary transmission line connected to said terminal for propagating said multiple RF signals of different frequencies;

(c) a plurality of non-resonant open-stub transmission lines each having a respective length, the plurality of open-stub transmission lines being capacitively loaded on the primary transmission line at spaced locations along the primary transmission line, wherein each open-stub transmission line effects perturbations in the signal carrying capability of the primary transmission line where the respective open-stub transmission line is located;

(d) the spacing between adjacent pairs of the plurality of open-stub transmission lines;

(i) is different from other pairs of adjacent open-stub transmission lines;

(ii) increases as the distance between the respective open-stub transmission line and the receiving terminal of the grating increases;

(e) the respective length of the open-stub transmission line:

increases linearly as the distance between the respective open-stub transmission line and the receiving terminal of the grating increases;

wherein said multiple RF signals of different frequencies propagating through the primary transmission line are reflected back to the terminal of the grating at different points along the primary transmission line where the respective open-stub transmission lines are located.

2. The grating of claim 1 further comprising a substrate, the primary transmission line and the plurality of the open-stub transmission lines are disposed on the substrate.

3. The grating of claim 2 wherein the primary transmission line and the plurality of open-stub transmission lines are high temperature superconductive films disposed on the substrate.

4. The grating of claim 2 wherein the primary transmission line and the plurality of open-stub transmission lines are normal conductors disposed on the substrate.

5. The grating of claim 1 wherein the spacing between a pair of adjacent open-stub transmission lines varies as a function of a multiple of the half-wavelength of a selected frequency, whereby the multiple RF signals of said selected frequency propagating through the primary transmission line is reflected back at points along the transmission line where the spacing between a pair of open-stub transmission lines is different from the adjacent spacing of another pair of open-stub transmission lines as determined by another frequency.

6. A microwave grating for a dispersive delay line, the grating comprising:

(a) a terminal for receiving a wideband RF signal including multiple RF signals of different frequencies;

(b) a primary transmission line connected to said terminal for propagating said multiple RF signals of different frequencies;

(c) a plurality of non-resonant open-stub transmission lines each having a respective length, the plurality of open-stub transmission lines being capacitively loaded on the primary transmission line at spaced locations along the primary transmission line, wherein each open-stub transmission line effects perturbations in the signal carrying capability of the primary transmission line where the respective open-stub transmission line is located; and (d) the spacing between adjacent pairs of open stub-transmission lines is different from other pairs of adjacent open-stub transmission lines;

wherein the multiple RF signals of different frequencies propagating through the primary transmission line are reflected back to the terminal of the grating at different points along the primary transmission line where the respective open-stub transmission lines are located.

7. A microwave grating for a dispersive delay line, the grating comprising:

(a) a terminal for receiving a wideband RF signal including multiple RF signals of different frequencies;

(b) a primary transmission line connected to said terminal for propagating said multiple RF signals of different frequencies;

(c) a plurality of non-resonant open-stub transmission lines each having a respective length, the plurality of open-stub transmission lines being capacitively loaded on the primary transmission line at spaced locations along the primary transmission line, wherein each open-stub transmission line effects perturbations in the signal carrying capability of the primary transmission line where the respective open-stub transmission line is located;

(d) the spacing between adjacent pairs of open-stub transmission lines:

(i) is different from other pairs of adjacent open-stub transmission lines;

(ii) increases as the distance between respective open-stub transmission lines and the receiving terminal of the grating increases;

(e) the respective length of the open-stub transmission line increases linearly as the distance between the respective open-stub transmission line and the receiving terminal of the grating increases;

wherein said multiple RF signals of different frequencies propagating through the primary transmission line are reflected back to the terminal of the grating at different points along the primary transmission line where the respective open-stub transmission lines are located.

8. A microwave grating frequency dispersive delay line comprising:

(a) an input terminal and an output terminal;

(b) a splitting/combining coupler for equally splitting a wideband RF signal input at the input terminal into two 90° out of phase signals, the splitting/combining coupler including a pair of output terminals, each output terminal carrying a respective one of the out of phase signals, wherein the splitting/combining coupler is electrically connected to the input terminal;

(c) a pair of microwave gratings equipped with non-resonant open stub transmission lines capacitively loaded and responsive to a predetermined operating frequency range for providing frequency disbursed signal reflection, each grating having a respective input terminal electrically connected to the pair of output terminals of the splitting/combining coupler, wherein the split out of phase signals propagate through the respective gratings and signals of different frequencies are reflected back to the splitter/combiner at points differentially spaced along the corresponding gratings; and (d) said splitter/combining coupler being electrically coupled through the respective terminals of the gratings for receiving the reflected signals from the gratings and combining the signals from the different points along the gratings into in-phase signals.

9. The delay line of claim 8 wherein each grating comprises:

(a) a respective primary transmission line being electrically connected to said corresponding terminal for propagating a wideband RF signal; and (b) the non-resonant open-stub transmission lines each having a respective length, wherein each open-stub transmission line effects perturbations in the signal carrying capability of the corresponding primary transmission line where the respective open-stub transmission line is located and wherein wideband RF signals including multiple RF signals at different frequencies propagating through the respective primary transmission lines are reflected back to the terminal of the corresponding grating at different points along the respective primary transmission line where the respective open-stub transmission lines are located.

10. A microwave grating for a dispersive delay line, the grating comprising:

(a) a terminal for receiving a wideband RF signal including multiple RF signals of different frequencies;

(b) a primary transmission line connected to said terminal for propagating said multiple RF signals of different frequencies;

(c) a plurality of non-resonant open-stub transmission lines each having a respective length, the plurality of open-stub transmission lines being capacitively loaded on the primary transmission line at spaced locations along the primary transmission line, wherein each open-stub transmission line effects perturbations in the signal carrying capability of the primary transmission line where the respective open-stub transmission line is located;

(d) the spacing between adjacent pairs of open-stub transmission lines:

(i) is different from other pairs of adjacent open-stub transmission lines;

(ii) decreases as the distance between the respective open-stub transmission line and the receiving terminal of the grating increases; and (e) the respective length of the open-stub transmission line decreases linearly as the distance between the respective open-stub transmission line and the terminal of the grating increases;

wherein the multiple RF signals of the selected frequency propagating through the primary transmission line is reflected back to the terminal of the grating at different points along the primary transmission line where the respective open-stub transmission lines are located.

11. Microwave grating for a dispersive delay line, the grating comprising:

(a) terminal means for receiving a wideband RF signal including multiple RF signals of different frequencies;

(b) a primary transmission line connected to said terminal means for propagating said multiple RF signals of different frequencies;

(c) a series of respective non-resonant open-stub transmission lines positioned at spaced apart locations along the primary transmission line, the said spacing between adjacent ones of the respective open-stub transmission lines varying as a function of a multiple of the half-wavelength of the wideband RF signal propagating through the primary transmission line;

(d) each said open-stub transmission line having a respective length that increases or decreases as the distance between the respective open-stub transmission lines and the receiving terminal increases or decreases;

wherein the wideband RF signal of the selected frequency propagating through the primary transmission line is reflected back at a point along the primary transmission line where the spacing between a respective pair of open-stub transmission lines varies as a function of the multiple of the half-wavelength of the wideband RF signal.

12. The microwave grating as claimed in claim 11 wherein the spacing between respective adjacent open-stub transmission lines and the length of the open-stub transmission lines increase linearly thereby providing a linear dispersive line.

13. The microwave grating as claimed in claim 11 wherein the spacing between respective adjacent open-stub transmission lines and the length of the respective open-stub transmission lines varies geometrically thereby providing a non-linear dispersive line.

* * * * *